United States Patent [19]

Schultes et al.

[11] Patent Number: 4,687,012

[45] Date of Patent: Aug. 18, 1987

[54] TELESCOPIC STICK FOR A SHORTENABLE UMBRELLA

[75] Inventors: Tilmann Schultes; Joachim Seidel, both of Solingen, Fed. Rep. of Germany

[73] Assignee: Kortenbach Verwaltungs-und Beteiligungsgesellshcaft mgH & Co., Soligen, Fed. Rep. of Germany

[21] Appl. No.: 825,436

[22] Filed: Feb. 3, 1986

[30] Foreign Application Priority Data

Jun. 7, 1985 [DE] Fed. Rep. of Germany ..... 3520518

[51] Int. Cl.[4] ..... A45B 19/04

[52] U.S. Cl. ..... 135/75

[58] Field of Search ..... 135/16-20, 135/24, 69, 75; 47/42, 43, 47; 248/188.5, 155, 333-338; 211/172, 197; 403/377-379

[56] References Cited

U.S. PATENT DOCUMENTS

| | | | |
|---|---|---|---|
| 401,536 | 4/1889 | Box | 135/28 |
| 1,174,701 | 3/1916 | Eklund | 248/188.5 |
| 1,185,650 | 6/1916 | Frantz | 135/75 |
| 2,165,967 | 7/1939 | Haupt | 135/75 |
| 2,771,261 | 11/1956 | Niggeloh | 248/188.5 |

FOREIGN PATENT DOCUMENTS

| | | | |
|---|---|---|---|
| 2430192 | 3/1980 | France | 47/47 |
| 1041928 | 9/1966 | United Kingdom . | |
| 1241619 | 8/1971 | United Kingdom . | |
| 1351305 | 4/1974 | United Kingdom . | |
| 1533631 | 11/1978 | United Kingdom . | |

*Primary Examiner*—James R. Feyrer

*Attorney, Agent, or Firm*—Samuel Meerkreebs

[57] ABSTRACT

A telescopic stick for a shortenable umbrella having at least two telescopic parts guided in one another so as to be secure against relative twisting or rotation about their longitudinal axes; the two parts being provided with complementary polygonal profile or cross-section; the polygonal profile comprising at least 10 facets which embellish the umbrella stick and improve its jewel-like appearance while functioning to prevent relative rotation and preserving stability of operation as the stick is telescoped from an umbrella "open" to "closed" condition; at least one of the facets of the polygonal cross section having a concave or convex curvature in the circumferential direction.

8 Claims, 6 Drawing Figures

TELESCOPIC STICK FOR A SHORTENABLE UMBRELLA

BACKGROUND OF THE INVENTION

The invention relates to a telescopic stick for a shortenable umbrella, the stick having at least two telescopic parts sliding one inside the other and secured against relative twisting by virtue of complementary polygonal cross sections associated one with each of the two parts, the parts being releasably lockable in mutually extended and/or retracted positions. Such a stick is hereinafter referred to as of the kind described.

Telescopic sticks with a prismatic profile of this kind, such as are known, for example, from the patent to Haupt; U.S. Pat. No. 2,165,962, and which are still used in the umbrella industry, hitherto fulfilled a purely functional purpose in the way that the telescopic parts of the telescopic stick, because of their square or hexagonal or polygonal cross-section, are, without expenditure for special refinements or parts, guided accurately in one another and secured against relative twisting, i.e. rotation, in order thereby to guarantee the necessary exact alignment of the different components of the umbrella with one another. In this way, the necessary alignment between the umbrella handle and certain release mechanisms at the bottom end of the stick, and the canopy kinematics at the top end of the stick, for opening and closing the umbrella, are controlled. Because of the wide fluctuations in tolerance of the dimensions of the raw stock material for polygonal tubes it is also known, for example, from the above-mentioned publication, and it is also current practice, to combine a polygonal tube with round tube in the telescopic stick, in which case polygonal reductions or sleeves are fitted onto the telescopic part manufactured from round tube, to complement the polygonal cross-section of the prismatic telescopic part. In any case, the fact is that the more a polygonal cross-sectional profile approximates that of a round cross-sectional profile, the more corners it has. Therefore, the security against relative twisting, and the accurate guidance, of the stick parts of a polygonal telescopic stick increases with the fewer the corners or facets, and decreases with the more the corners or facets; the general practice of the umbrella industry hitherto a has been to use, for shortenable umbrellas, only telescopic sticks having an external polygonal profile of not more than six corners or facets. Since the security against twisting, and the guidance, are furthermore also influenced by the fluctuations in tolerance of the tube material, the employment of polygonal tube having more than six corners or facets for telescopic sticks of shortenable umbrellas has proved to be impractical in the past. But on the other hand, it is desirable to avoid, in the case of a pocket umbrella, an appearance which leaves too functional an impression, and also to impart to the very conspicuous telescopic stick of such an umbrella a decoratively pleasing look of at least equal value to the functional external appearance. But a telescopic stick having just a few corners, in accordance with the usual practice, appears to be too clumsy and functional.

SUMMARY OF THE INVENTION

The object of the invention is to create for a shortenable umbrella, a telescopic stick of the kind described, which is both functionally sound and guarantees precise security against relative twisting, and guidance of the telescopic parts in one another, and also provides an aesthetically satisfying appearance without additional outlay or additional parts being needed.

This problem is solved in accordance with the present invention, if a telescopic stick of the kind described is characterized in that each of the polygonal cross sections comprises at least ten facets, at least one of which has a concave or convex curvature in the circumferential direction, whereby the or each complementary pair of concave or convex facets form interengaging longitudinal guides which provide the security against relative twisting.

A telescopic stick for shortenable umbrellas, or so-called pocket umbrellas, having at least two telescopic parts guided in one another and secure against relative twisting, is thus created. On the one hand, the stick has effectively an appearance of a shiny glittering prismatoid, similar to the polished edges on a piece of jewllery, but on the other hand also, in spite of its multifaceted polygonality approximating very closely to a circular cross-sectional shape, enables exact guidance of the telescopic parts in one another with security against relative twisting. The concave or convex facets are so completely integrated into the physical appearance of this telescopic prismatoid that they do not attract attention optically and shine just like the remaining facets and blend with them into the overall design.

A particularly advantageous refinement, and an additional function without additional outlay, follows if the concave or convex facets have stepped ends forming stops which engage one another to limit the telescopic movement of the two parts in the extended direction.

Each polygonal cross section may comprise a pair of diametrically opposite facets having the concave or convex curvature.

A completely uniform design of the telescopic stick as a multifaceted prismatoid may be achieved if all of the facets of the polygonal cross sections are uniformly shaped with the concave or convex curvature.

BRIEF DESCRIPTION OF THE DRAWINGS

Examples of umbrella sticks constructed in accordance with the invention are illustrated in the accompanying drawings, in which.

DESCRIPTION OF THE PREFERRED EMBODIMENTS

Figure 2:
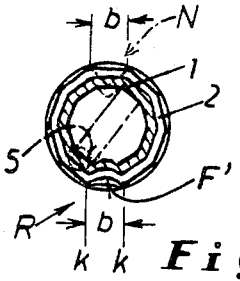
FIG. 2 is an enlarged section taken on the plane of line A—A of FIG. 1.
Figure 4:
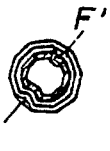
FIG. 4 is a section taken on the plane of line C—C of FIG. 3.
Figure 1:
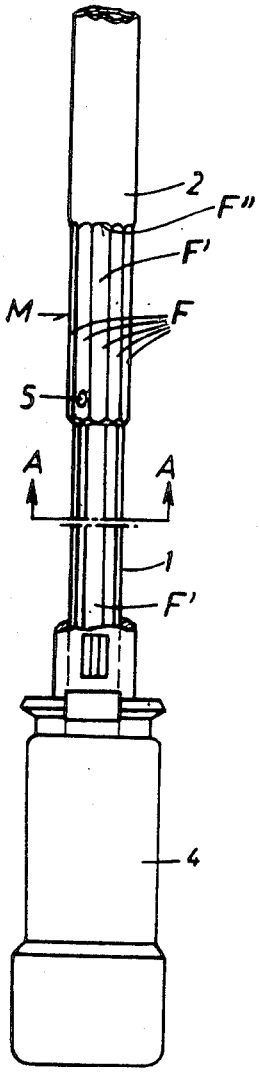
FIG. 1 is an elevation of a portion of one telescopic stick having two telescopic parts, each of which has ten facets.
Figure 3:
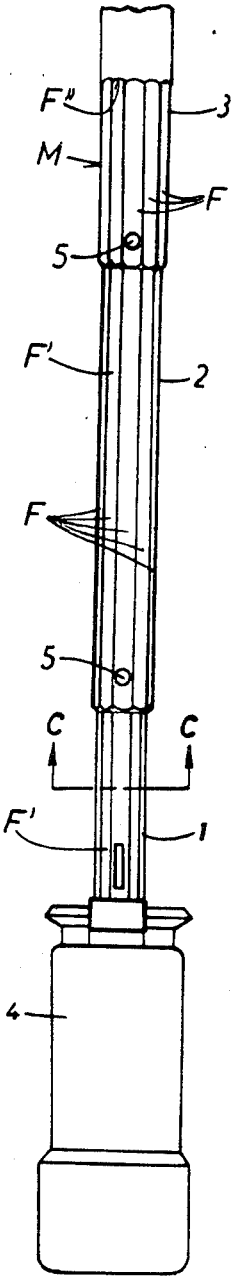
FIG. 3 is an elevation of a portion of a three-part telescopic stick, having in each case ten facets.

The illustrated telescopic sticks have at least two tubular telescopic parts 1 and 2, guided in one another and secure against relative twisting, in accordance, say, with FIGS. 1 and 2, or else more than two such telescopic parts, for example, three telescopic parts 1, 2 and 3 corresponding to FIGS. 3 and 4. In the case of the telescopic stick in accordance with FIGS. 1 and 2, the telescopic part 1 guided in the telescopic part 2 is connected to a handle 4 of the umbrella, whilst the outer telescopic part 2 at its top end carries the umbrella canopy (not shown). In the case of the three-part telescopic stick in accordance with FIGS. 3 and 4, the thinnest inner telescopic part 1 is connected to the umbrella handle 4 and guided, and secure against twisting, in the middle telescopic part 2 which in turn is guided and secure against twisting, in the outer telescopic part 3 which carries the umbrella canopy (not shown). The telescopic arrangement can obviously also be reversed so that then the telescopic part 1 fixed to the umbrella handle 4 would be at the canopy end and the telescopic part 2 or 3 respectively described above as next to the canopy would be next to the handle. But the telescopic stick may comprise even more than three telescopic parts.

The telescopic parts 1 and 2 or respectively 1, 2 and 3 may, by means of a locking and release mechanism known in itself but not shown in greater detail, be able to be locked and released with respect to one another in their pushed-in, retracted, and/or pushed-out, extended, positions. This mechanism may involve, e.g., ball catches 5, inside the telescopic parts 1, 2 and 3. The pulling-out and/or the pushing-in of the telescopic parts may be effected manually or automatically with the aid of means known in themselves but likewise not shown.

In order for the pulling-out and the pushing-in of the telescopic parts 1, 2 and 3 to be secure against twisting, for the purpose of the necessary alignment between the umbrella handle 4 and the umbrella canopy which is not shown, previous telescopic sticks of polygonal cross-section have had not more than six facets and corners. Such polygonal cross-sections guarantee a practicable security against twisting, and straight guidance, of the telescopic parts in one another without there being needed any special or additional means. Polygonal cross-sections which have a number of corners exceeding six no longer guarantee this function with adequate security and consequently either are not used, or else are employed in conjunction with additional means for the security against twisting, and for the guidance. The insufficient security against twisting, and the insufficient guidance, follows from the polygonal cross-section of the telescopic parts with a larger number of corners and facets approximating more and more to a circular cross-section so that the corners lose guidance and resistance to twisting. This instability in respect of the guidance, and security against twisting, of the telescopic stick, is still further aggravated by the fact that, in itself, the stick has a comparatively small cross-section, and furthermore the tube material employed for the stick parts frequently results in dimensional tolerances of the cross-section during manufacture. But on the other hand, a polygonal telescopic stick, say, of the usual type sold on the market at the present time, seems, because of the employment of polygonal tube material having only a few corners and facets, to have an appearance which is too mechanically functional in design.

Figure 6:
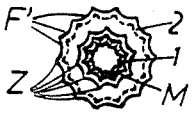

In order to impart to the telescopic stick a decorative appearance, the telescopic parts 1 and 2, or respectively 1, 2 and 3, have in each case at least ten corners K or facets F, or their guide sleeves M associated with one stick part of each adjacent pair have corresponding corners K or facets F. This faceting gives the telescopic stick the appearance of a prismatoid decorative article, the facets F or the corners K respectively appearing like glittering polished edges. In order that the polygonal profile, approximating to a circular cross-section, of the telescopic parts 1, 2, 3 or guide sleeves M may not result in loss of security against twisting and longitudinal guidance, without significant additional extra outlay, at least one facet F′ is, in its width b in the polygonal profile from corner K to corner K and around the telescopic axis X—X, concave or convex, that is, curved or otherwise projecting radially inwards or outwards, e.g. in a rounded form R or in a kinked form N (FIG. 2). The concave or convex facets F′, which engage in one another and allow relative shifting longitudinally of the respective adjacent stick parts, form the security against twisting and the longitudinal guidance for the telescopic parts 1, 2, 3 whilst blending into the multifaceted shining prismatoid of the stick, and without attracting attention to whether the curved facets F′ also form functional elements. Instead of one such facet F′ per telescopic part 1, 2, 3 or guide sleeve M there may also be provided two facets F′,F′ lying diametrically opposite one another (FIG. 4). Indeed, all of the facets F may be deformed uniformly, that is, as concave or convex facets F′ all round the polygonal profile, as shown in FIGS. 5 and 6, so that the polygonal profile of the cross-section appears similar to a ring of teeth with a scalloped formation Z.

Of the telescopic parts 1, 2, 3 the outer part 2 or 3 may, for example, also be partially round in cross-section and partially polygonal (FIGS. 1, 2), the polygonal portion being formed by a guide sleeve M for the guidance and security against twisting of the adjacent telescopic part 1 or 2. All of the types of facets F′, that is, both the round and angular facets R,N, as also the scalloped formation Z, may terminate without a step, or else end abruptly at one end with the formation of a step F″ (FIGS. 1 and 3). The step F″ may, for example, be aligned with one of the facets F′ in the region of the guide sleeve M of the telescopic part 2 (FIG. 1) or of the telescopic part 3 (FIG. 3) and in the pulled-out state of the telescopic parts 1, 2, 3 may cooperate with a counterstop on the other adjacent telescopic part (for example, Part 1 with Part 2 and Part 2 with Part 3). A complete pulling apart, that is, an unwanted separation of the telescopic parts 1, 2, 3 is thereby prevented without additional parts being needed.

Figure 5:
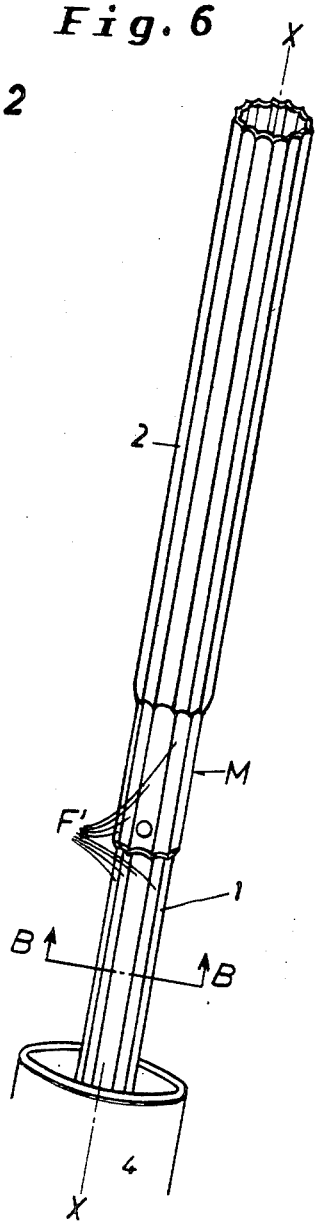
FIG. 5 is a perspective view of a portion of a two-part telescopic stick in a combined form of ten and fourteen facets, to an enlarged scale; and, FIG. 6 is a section taken on the plane of line B—B of FIG. 5.

The variant of a two-part telescopic stick in accordance with FIG. 5 shows a particularly fine shining jewelled effect because the polygonal cross-section of the telescopic part 2 has fourteen facets F or F′. This gives a different shimmering effect because a guide sleeve M having ten facets F′ is fixed onto the fourteen-faceted telescopic part 2. The non-rotational guidance of the telescopic part 1 in the guide sleeve M is brought about by all of the facets F′ being made as scalloping Z, in combination with a complementary profiling Z of the facets F′ on the telescopic part 1.

We claim:

1. A telescopic stick of the hollow prismatic type for a shortenable umbrella, the stick having at least two, hollow telescopic parts sliding one inside the other and secured against relative twisting with respect to each other by having cross sections with complimentary polygonal profiles, means releasably-locking the parts in mutually extended and retracted positions; the improvement characterized in that each of the polygonal profiles comprise at least ten facets, said facets having a rectilinear flat shape along at least part of the length thereof, at least one of the facets in its extent from one edge to the next having an arcuate indentation extending in the cross-section thereof and along at least part of the length of said facet, whereby the complementary pair of the arcuate facets of the telescoping parts form interengaged longitudinal guides which prevent the respective longitudinal twisting of the stick parts while the ten faceted cross sections substantially approach a circular appearance, said stick being formed of a highly reflective material.

2. A telescopic stick according to claim 1, characterized in that the facets have stepped ends forming stops engagable with each other and limiting the telescopic movement of the telescoped stick parts in an extended position.

3. A telescopic stick according to claim 1, characterized in that the polygonal profile of each of the respective stick parts include diametrically opposite facets having an arcuate indentation along at least part of the length thereof.

4. A telescopic stick according to claim 1, characterized in that all of the facets of the polygonal profiles are uniformly shaped and have an arcuate configuration from edge-to-edge.

5. The structure as claimed in claim 1 in which said facets extend partially along the length of one of said telescopic parts.

6. The structure as claimed in claim 1 including a third telescoped part complimentary to and telescopically engaging one of said first-mentioned parts, said third part including a multi-faceted cross section complimentary to the polygonal profile of the part with which it is telescoped.

7. The structure as claimed in claim 1 in which said polygonal cross section prevents relative rotation of the respective parts, the faceting of said parts extending a substantial extent along the length thereof and appearing as a reflective decorative prismatoid with glittering polished edges.

8. The structure as claimed in claim 7 in which said facets are arcuate.

* * * * *